US012653291B2

(12) United States Patent
Kim et al.

(10) Patent No.: US 12,653,291 B2
(45) Date of Patent: Jun. 16, 2026

(54) HAIR DRYER

(71) Applicant: LG ELECTRONICS INC., Seoul (KR)

(72) Inventors: Kyoungtae Kim, Seoul (KR); Hyunchul Kim, Seoul (KR); Yunhee Ku, Seoul (KR); Rayoung Park, Seoul (KR); Dongwon Kim, Seoul (KR); Taegil Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 539 days.

(21) Appl. No.: 18/260,289

(22) PCT Filed: Jan. 3, 2022

(86) PCT No.: PCT/KR2022/000014

§ 371 (c)(1),
(2) Date: Jul. 3, 2023

(87) PCT Pub. No.: WO2022/146119

PCT Pub. Date: Jul. 7, 2022

(65) Prior Publication Data

US 2024/0057739 A1 Feb. 22, 2024

(30) Foreign Application Priority Data

Jan. 4, 2021 (KR) ..... 10-2021-0000331

(51) Int. Cl.
*A45D 20/12* (2006.01)

(52) U.S. Cl.
CPC ..... *A45D 20/124* (2013.01)

(58) Field of Classification Search
CPC ..... A45D 20/122; A45D 20/10; A45D 20/12
See application file for complete search history.

(56) References Cited

U.S. PATENT DOCUMENTS

| | | | | |
|---|---|---|---|---|
| 4,972,065 | A * | 11/1990 | Ohlsen | A45D 20/12 34/97 |
| 2018/0036553 | A1* | 2/2018 | Shiibashi | A45D 20/12 |
| 2020/0178667 | A1* | 6/2020 | Pang | A45D 20/12 |

FOREIGN PATENT DOCUMENTS

| | | | | |
|---|---|---|---|---|
| EP | 3412172 | A1 * | 12/2018 | A45D 20/12 |
| KR | 10-2018-0017193 | | 2/2018 | |
| KR | 10-2020-0018575 | | 2/2020 | |

* cited by examiner

*Primary Examiner* — Jessica Yuen
(74) *Attorney, Agent, or Firm* — LEE, HONG, DEGERMAN, KANG & WAIMEY

(57) ABSTRACT

A hair dryer may be provided, the hair dryer comprising: a body having a gas outlet part through which gas is discharged out of the body; and a handle extending from the body, wherein: the gas outlet part comprises a sensor unit which is provided at the center of the gas outlet part to sense coupling between the body and a diffuser coupled to the body and a coupler which is annularly provided along the circumference of the gas outlet part to surround the sensor unit; the diffuser is coupled to the body through the coupler; and the sensor unit is provided to be opposite to the diffuser. As such, a user can easily couple a diffuser to the hair dryer. In addition, the user can easily use additional functions of the diffuser. That is, user convenience can be enhanced.

14 Claims, 9 Drawing Sheets

【Fig. 1】
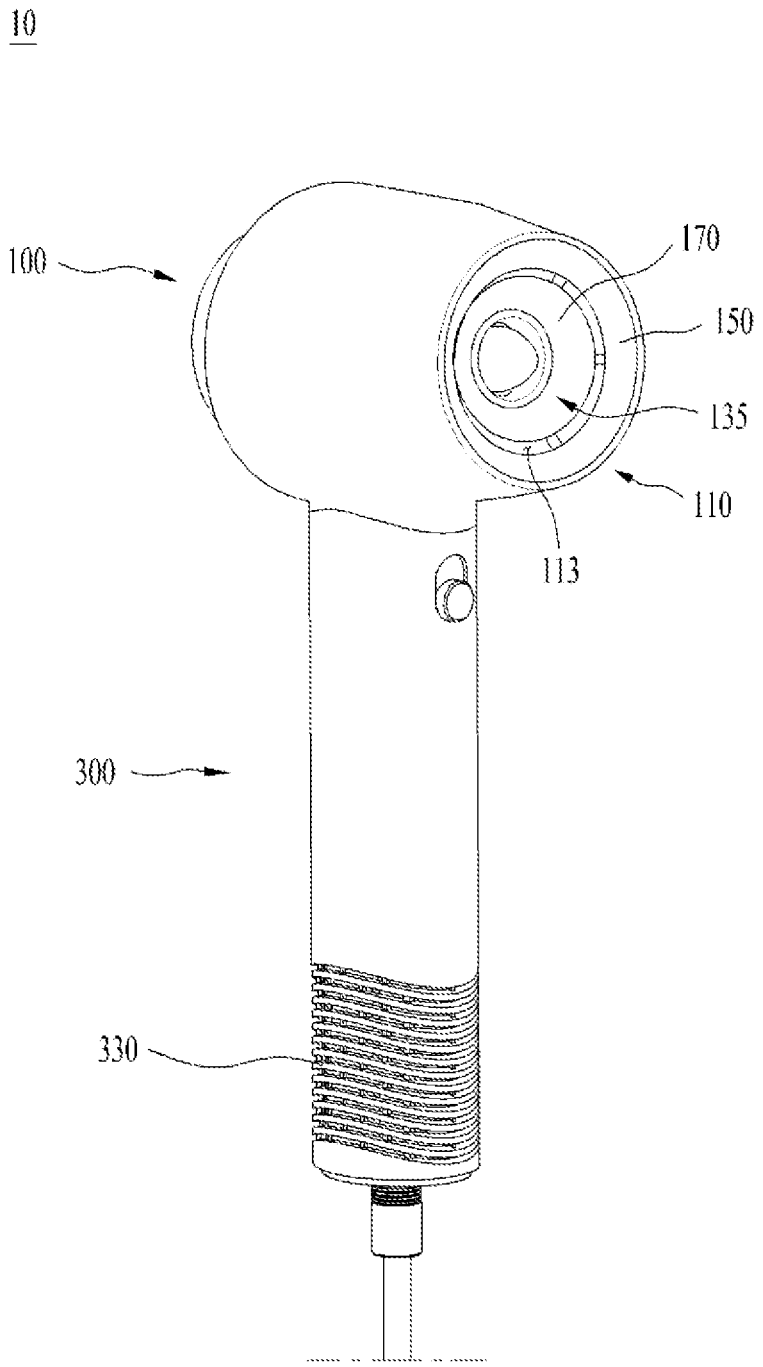

【Fig. 2】
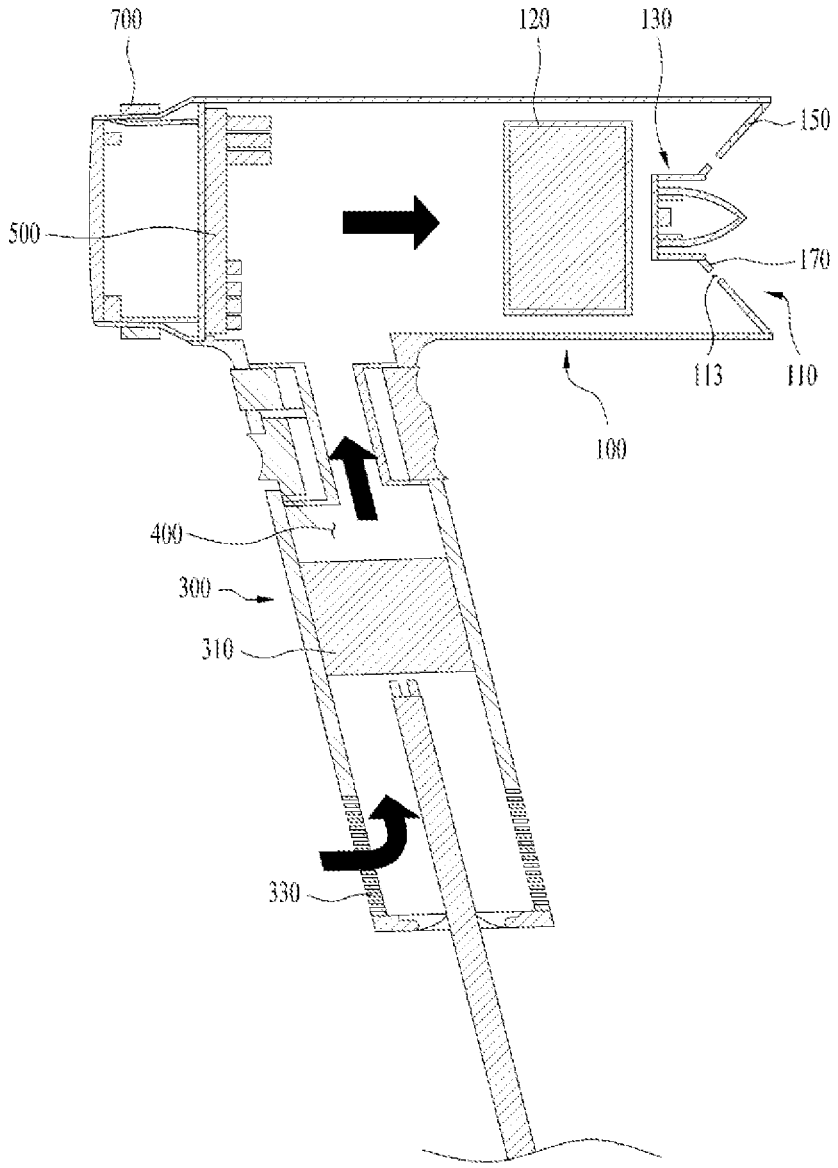

[Fig. 3]
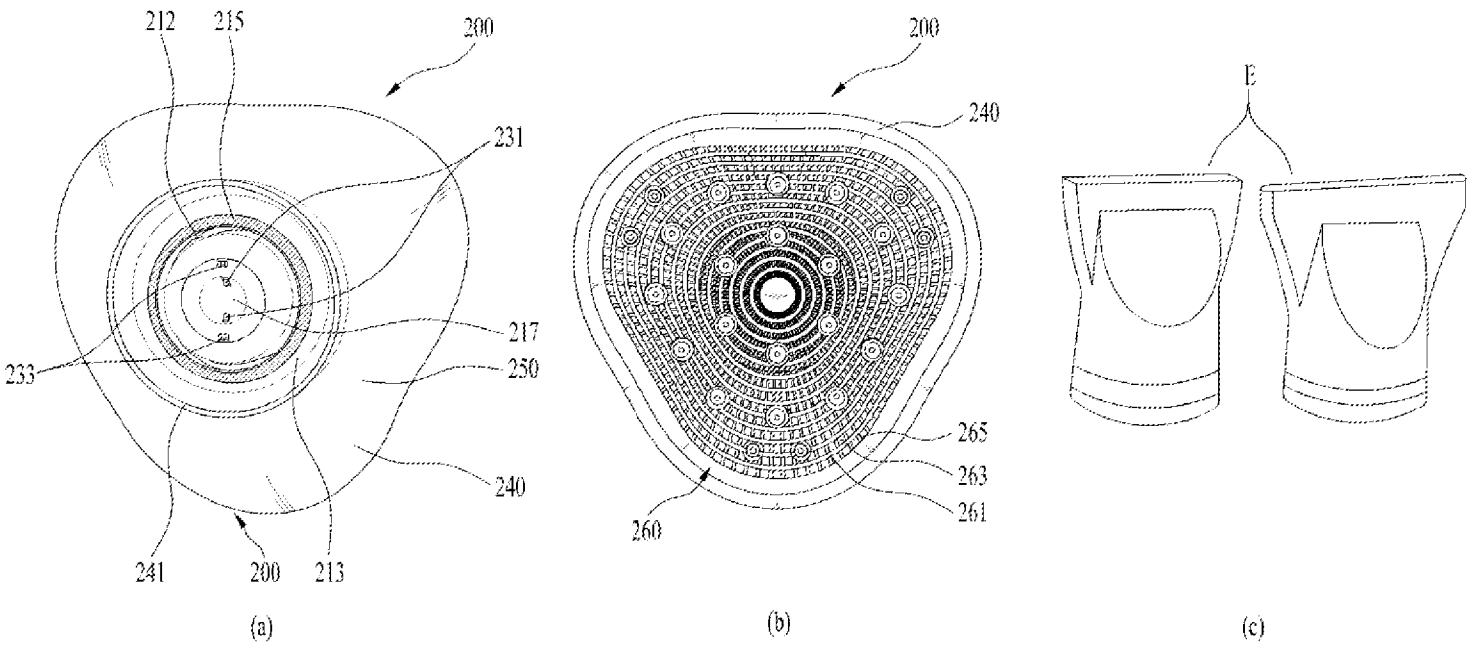

【Fig. 4】
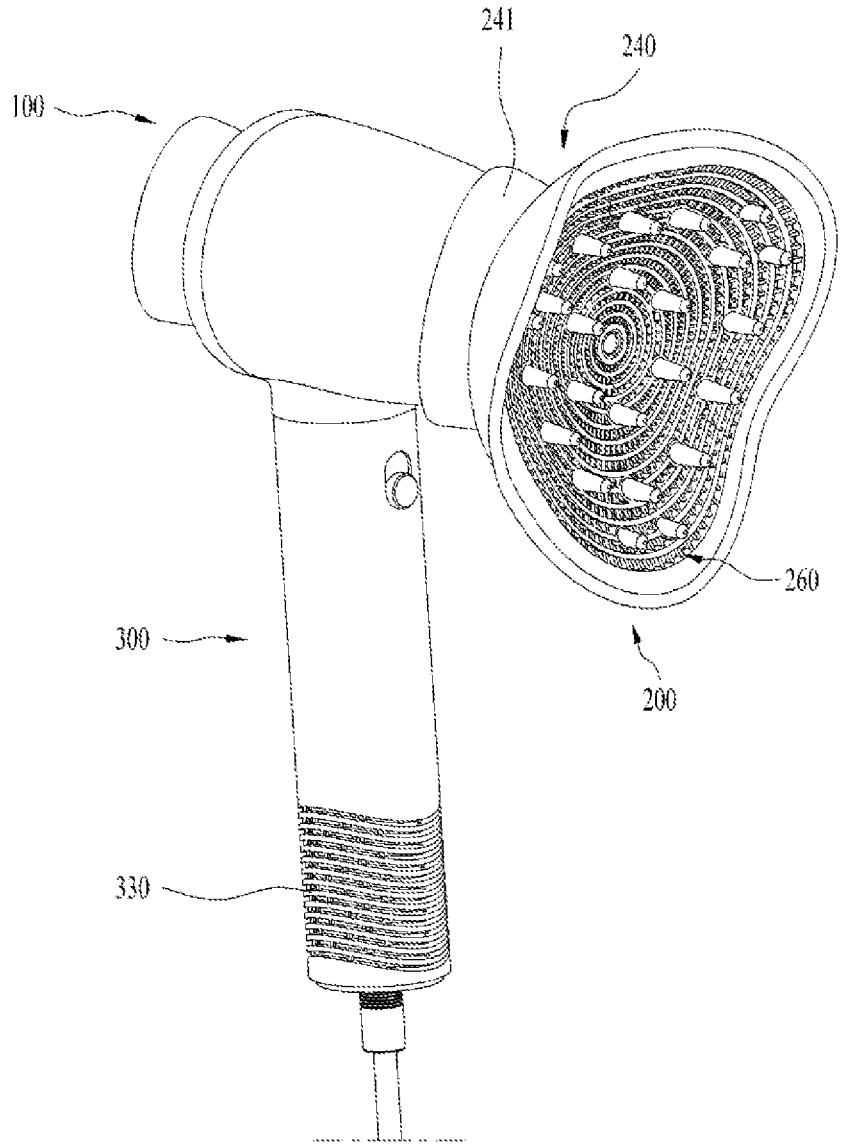

[Fig. 5]
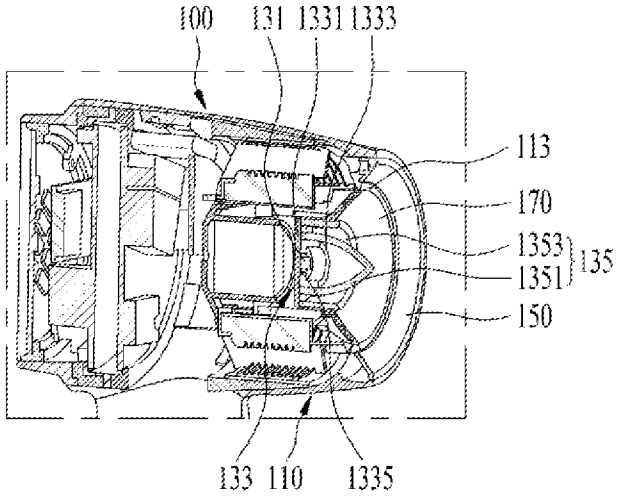
(b)
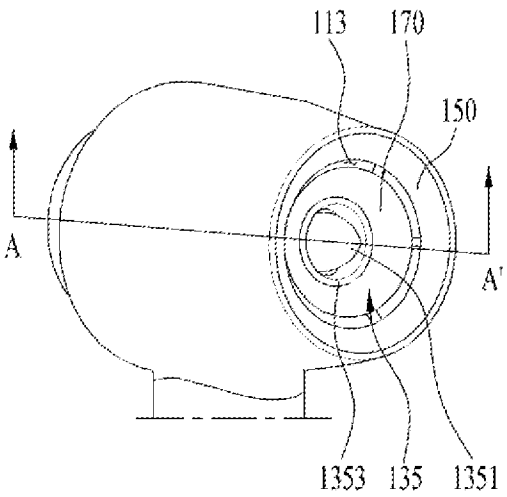
(a)

【Fig. 6】
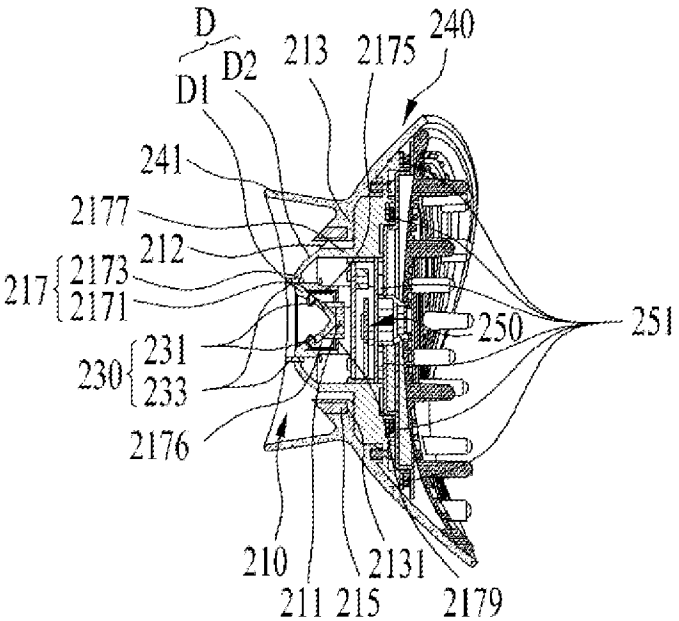
(b)
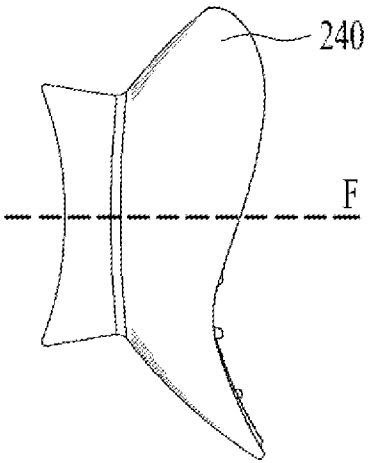
(a)

【Fig. 7】
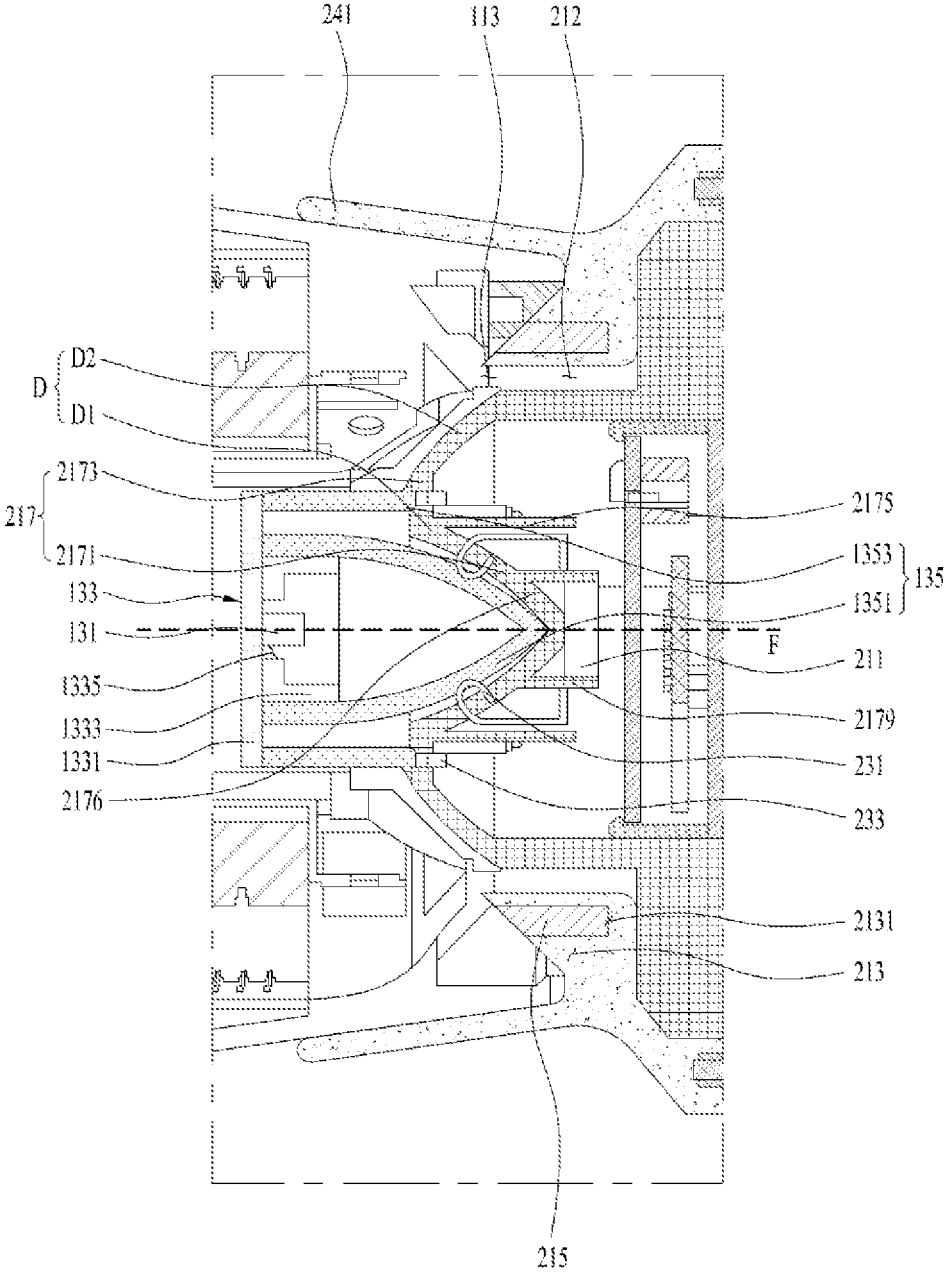

【Fig. 8】
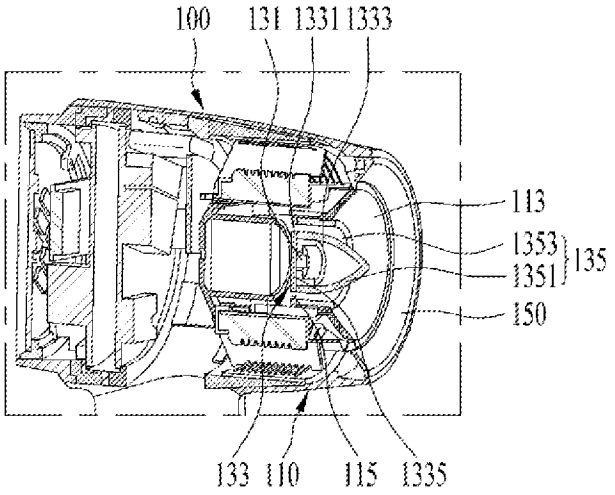
(b)
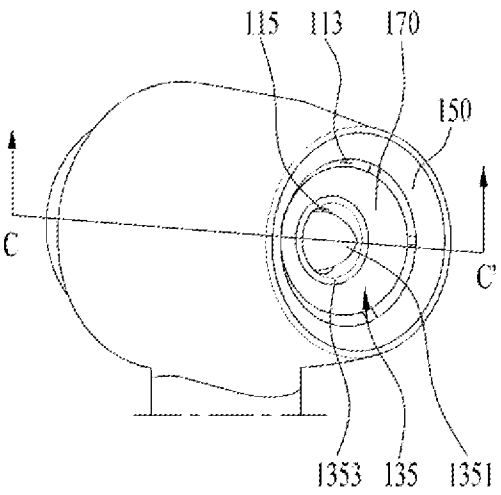
(a)

【Fig. 9】
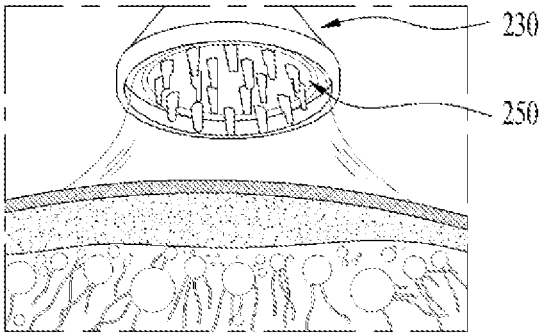

HAIR DRYER

CROSS-REFERENCE TO RELATED APPLICATIONS

This application is the National Stage filing under 35 U.S.C. 371 of International Application No. PCT/KR2022/000014, filed on Jan. 3, 2022, which claims the benefit of earlier filing date and right of priority to Korean Application No. 10-2021-0000331, filed on Jan. 4, 2021, the contents of which are all hereby incorporated by reference herein in their entireties.

TECHNICAL FIELD

The present disclosure relates to a hair dryer, and more particularly, a hair dryer from which gas introduced into a gas inlet is discharged via a gas discharger.

BACKGROUND

When human hair is dried as desired from a wet state or styled from a current shape to a desired shape, a hair dryer that discharges gas via a gas discharger may be used.

When a user dries hair with the hair dryer in a situation in which the hair is wet, the hair dryer may provide gas characteristics desired by the user, such as a gas temperature, a gas speed, a gas flow area, and the like.

Accordingly, a diffuser having various shapes may be coupled to the hair dryer to provide gas with the characteristics desired by the user. Furthermore, the hair dryer may perform additional functions such as anion care and LED care in addition to the function of drying the hair. The above-mentioned additional functions may be provided to the user by being equipped in the diffuser that is coupled to the hair dryer.

However, when the hair dryer is coupled to the diffuser that performs the additional functions such as the anion care and the LED care, the hair dryer must recognize that the diffuser that performs the additional functions is coupled thereto. Accordingly, the hair dryer may supply power to the diffuser that performs the additional functions. Furthermore, the user may determine whether the coupling of the hair dryer and the diffuser is correct.

Accordingly, there is an increasing demand for the hair dryer that may be coupled with the diffuser regardless of a coupling direction of the diffuser (a rotation direction with a virtual line passing through a center of the diffuser as a rotation axis) that performs the additional functions for user convenience.

Furthermore, there is an increasing demand for the hair dryer that recognizes the coupling of the diffuser that performs the additional functions regardless of the coupling direction of the diffuser that performs the additional functions.

SUMMARY

Technical Problem

Embodiments of the present disclosure are to provide a hair dryer that is easy to be coupled to a diffuser.

Embodiments of the present disclosure are to provide a hair dryer in which a sensor assembly may sense coupling of a diffuser regardless of a direction (a rotation direction using a virtual line passing through a center of the diffuser as a rotation axis) of one surface where the diffuser is coupled to the hair dryer.

Embodiments of the present disclosure are to provide a hair dryer in which additional functions of a diffuser are performed when a sensor assembly senses coupling of the diffuser.

Technical Solutions

An example for solving the above-mentioned problem is to provide a hair dryer to which a diffuser may be coupled regardless of a coupling direction (a rotation direction using a virtual line passing through a center of the diffuser as a rotation axis) of one surface where the diffuser is coupled to the hair dryer.

Furthermore, an example for solving the above-mentioned problem is to provide a hair dryer that may recognize coupling of a diffuser regardless of a coupling direction (a rotation direction using a virtual line passing through a center of the diffuser as a rotation axis) of one surface where the diffuser is coupled to the hair dryer. Furthermore, it is to provide a hair dryer that performs additional functions of a diffuser when coupling of the diffuser is recognized.

According to the present embodiments, a hair dryer includes a main body having a gas discharger configured to discharge gas, and a handle disposed on the main body, the gas discharger includes a sensor assembly disposed at a center of the gas discharger and sensing coupling of a diffuser to be coupled to the main body and the main body, and a coupling portion surrounding the sensor assembly and formed in an annular shape along a circumference of the gas discharger, and the diffuser is coupled to the main body via the coupling portion, and the sensor assembly faces the diffuser.

Furthermore, the gas discharger may further include a coupling auxiliary portion disposed between the coupling portion and the sensor assembly and formed in an annular shape to surround the sensor assembly, and a gas discharge hole defined between the coupling auxiliary portion and the coupling portion, wherein gas is discharged via the gas discharge hole.

Furthermore, the gas discharger may be disposed at a front side of the main body, and the coupling portion and the coupling auxiliary portion may be curved to be recessed rearward toward the sensor assembly.

Furthermore, the sensor assembly may include a sensor that senses the coupling of the diffuser and the main body by sensing magnetism generated from the diffuser, a sensor seating portion disposed at the center of the gas discharger, wherein the sensor is seated on the sensor seating portion, and a sensor protecting portion extending forward from the sensor seating portion and surrounding the sensor.

Furthermore, the diffuser may include a housing forming an outer appearance of the diffuser, and a gas inlet disposed at one side of the housing and in communication with the gas discharger to allow gas to be introduced from the gas discharger, the gas inlet may include a recognizing magnetic body disposed at a position corresponding to the sensor assembly and having magnetism, and the sensor assembly may sense the coupling of the diffuser and the main body using the magnetism of the recognizing magnetic body.

Furthermore, the gas inlet may further include a main body coupling portion formed in an annular shape along a circumference of the gas inlet to surround the recognizing magnetic body and disposed at a position corresponding to the coupling portion, and a coupling magnetic body formed in an annular shape in the main body coupling portion and coupled to the coupling portion by a magnetic force.

Furthermore, the main body coupling portion may include a coupling magnetic body receiving portion defined as one surface of the main body coupling portion facing the coupling portion is recessed, wherein the coupling magnetic body receiving portion receives the coupling magnetic body therein.

Furthermore, the housing may include a receiving coupling portion extending from an outer circumferential surface of the main body coupling portion toward the main body and receiving the main body therein, and the main body coupling portion may be coupled to the main body such that the receiving coupling portion surrounds the main body.

Furthermore, the recognizing magnetic body may have first magnetism and the coupling magnetic body may have second magnetism different from the first magnetism, and the sensor assembly may sense the first magnetism to sense the coupling of the diffuser and the main body.

Furthermore, the gas inlet may further include a recognizing magnetic body receiving portion disposed at a center of the gas inlet to surround the recognizing magnetic body, and providing a space for receiving the recognizing magnetic body.

Furthermore, the sensor assembly may include a sensor that senses the magnetism of the recognizing magnetic body, a sensor seating portion disposed at the center of the gas discharger, wherein the sensor is seated on the sensor seating portion, and a sensor protecting portion extending from the sensor seating portion toward the recognizing magnetic body and disposed to surround the sensor, and one surface of the recognizing magnetic body receiving portion facing the sensor protecting portion may be recessed to receive at least a portion of the sensor protecting portion therein.

Furthermore, the coupling auxiliary portion may be non-magnetic.

Furthermore, the gas inlet may further include a gas inlet hole defined between the recognizing magnetic body receiving portion and the main body coupling portion, wherein gas that has passed through the gas discharge hole is introduced into the gas inlet hole.

Furthermore, the diffuser may further include a module disposed inside the housing, the module may include a plurality of lamps spaced apart from a center of the module in a radial direction of the module, and the lamp may be turned on when the sensor assembly senses the coupling of the diffuser and the coupling portion.

Advantageous Effects

According to the embodiments of the present disclosure, the user may easily couple the diffuser to the hair dryer.

Furthermore, according to the embodiments of the present disclosure, the coupling of the diffuser that performs the additional functions and the hair dryer may be easily sensed by the sensor assembly.

Furthermore, according to the embodiments of the present disclosure, the additional functions of the diffuser may be easily performed as the coupling of the diffuser that performs the additional functions and the hair dryer is easily sensed by the sensor assembly.

BRIEF DESCRIPTION OF THE DRAWINGS

FIG. 1 is a perspective view of a hair dryer according to one embodiment of the present disclosure to which a diffuser is not coupled.

FIG. 2 is a view showing an internal cross-section of a hair dryer shown in FIG. 1.

FIG. 3 is a view showing a diffuser according to an embodiment of the present disclosure.

FIG. 4 is a perspective view of a hair dryer coupled with a diffuser according to an embodiment of the present disclosure.

FIG. 5 is a view showing a main body according to one embodiment of the present disclosure.

FIG. 6 is a view showing a diffuser according to one embodiment of the present disclosure.

FIG. 7 is a diagram showing a portion where a main body and a diffuser are coupled to each other according to one embodiment of the present disclosure.

FIG. 8 is a view showing a main body having a gas discharge auxiliary hole defined therein according to one embodiment of the present disclosure.

FIG. 9 is a view showing a hair dryer that performs additional functions by a diffuser according to an embodiment of the present disclosure.

DETAILED DESCRIPTION

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, to clearly describe the present disclosure, components irrelevant to the description are omitted in the drawings. Further, similar reference numerals are assigned to similar components throughout the present document.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

Furthermore, the terminology used herein is for the purpose of describing the specific embodiment of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, herein, the term 'and/or' includes a combination of a plurality of listed items or any of the plurality of listed items. Herein, 'A or B' may include 'A', 'B', or 'both A and B'.

FIG. 1 is a perspective view of a hair dryer from which a diffuser is removed according to one embodiment of the present disclosure, and FIG. 2 is a view showing an internal cross-section of a hair dryer shown in FIG. 1. A hair dryer according to one embodiment of the present disclosure includes a main body 100, a handle 300, and a gas discharger 110 as shown in FIGS. 1 and 2.

As shown in FIG. 2, the main body 100 may have a gas flow channel 400 defined therein through which gas flows, and have the gas discharger 110 through which internal gas is discharged to the outside. The main body 100 may have a shape extending in a front and rear direction and may have various cross-sectional shapes such as a circular or a polygonal shape when viewed from the front.

In the present disclosure, definitions of front, rear, left, right, upper, and lower sides may be centered on the main body 100. For example, referring to FIG. 2, the gas discharger 110 may be disposed at a front side of the main body 100, and the handle 300 may have a shape extending substantially downward from the main body 100.

Gas flowing inside the main body 100 may be introduced through a main gas inlet 330, and the main gas inlet 330 may be defined in the main body 100 or the handle 300. When the main gas inlet 330 is defined in the handle 300, the gas flow channel 400 may extend from the handle 300 to the main body 100. That is, the gas flow channel 400 may extend from the main gas inlet 330 to the gas discharger 110.

Gas may be introduced from the outside via the main gas inlet 330 defined in the main body 100 or the handle 300, and gas introduced to the inside may flow along the gas flow channel 400 and be discharged to the outside via the gas discharger 110 disposed at the main body 100.

The handle 300 may extend from the main body 100. FIGS. 1 and 2 show the handle 300 extending downward from the main body 100. The handle 300 may be integrally molded with the main body 100 or manufactured separately and coupled to the main body 100.

When the handle 300 is manufactured separately from the main body 100 and coupled to the main body 100, the handle 300 may be formed such that a longitudinal direction with respect to the main body 100 is fixed or variable.

For example, the handle 300 may have a hinge coupling portion, and may be coupled to the main body 100 such that the longitudinal direction of the handle 300 may be changed, that is, the handle 300 may be foldable with respect to the main body 100.

The handle 300 may be a portion gripped by a user with hand, and thus, may have a shape to improve grip convenience. There may be various extension directions of the handle 300, but for convenience of description, the direction in which the handle 300 extends from the main body 100 is the downward direction.

Referring to FIG. 2, the hair dryer according to one embodiment of the present disclosure includes a fan unit 310 that may allow gas to flow and adjust a speed of gas discharged via the gas discharger 110. The fan unit 310 may be disposed in the gas flow channel 400 to allow gas to flow, and may be disposed inside the main body 100 or inside the handle 300.

For example, when the main gas inlet 330 is defined in the handle 300, the gas flow channel 400 may extend from the main gas inlet 330 of the handle 300 to the gas discharger 110 of the main body 100, and the fan unit 310 may be disposed in the gas flow channel 400 located inside the handle 300.

Furthermore, a temperature adjust unit 120 that may adjust a temperature of discharged gas may be disposed inside the main body 100. FIG. 2 schematically shows the temperature adjust unit 120 disposed inside the main body 100.

Furthermore, the temperature adjust unit 120 may be of various types. The temperature adjust unit 120 may be in a scheme of heating gas by providing current to a resistor in a form of a coil to generate heat.

However, the resistor of the temperature adjust unit 120 may not necessarily be in the form of the coil, and may be of various types that may heat gas or adjust the temperature of gas using, for example, a thermoelectric element.

A schematic description of an operation scheme of the hair dryer according to one embodiment of the present disclosure along with the gas flow is as follows.

First, the user manipulates a power button disposed on the main body 100 or the handle 300. When the power button is pressed, the fan unit 310 operates and gas is introduced into the hair dryer via the main gas inlet 330.

Gas introduced via the main gas inlet 330 flows along the gas flow channel 400 by the fan unit 310 toward the gas discharger 110, and gas is discharged from the gas discharger 110 and provided to the user.

In such process, the flow speed of gas in the gas flow channel 400 may be adjusted by the fan unit 310 and the temperature of gas may be adjusted by the temperature adjust unit 120. Adjustment of operation states of the fan unit 310 and the temperature adjust unit 120 may be performed by the user manipulating a manipulation unit 500, or may be automatically performed based on an operation mode preset in a controller 700.

In one example, the user may dry hair using gas discharged via the gas discharger 110 of a hair dryer 10. However, a diffuser 200 may be coupled to the main body 100 to provide gas having characteristics (the gas temperature, the gas speed, and a gas flow area) desired by the user. Furthermore, the diffuser 200 that may allow additional functions such as anion care function and an LED care function to be performed may be coupled.

Accordingly, the hair dryer 10 according to one embodiment of the present disclosure may be coupled to the diffuser 200 of various shapes.

FIG. 3 is a view showing a diffuser according to an embodiment of the present disclosure. FIG. 4 is a perspective view of a hair dryer coupled with a diffuser according to an embodiment of the present disclosure.

Specifically, (a) in FIG. 3 shows one surface coupled to the main body of the diffuser that may perform the LED care function, and (b) in FIG. 3 shows the other surface of the diffuser shown in (a) in FIG. 3 through which gas is discharged. (c) in FIG. 3 shows a diffuser with various flow channels therein.

Referring to FIGS. 3 and 4, the hair dryer 10 according to one embodiment of the present disclosure may be coupled with the diffuser 200 of the various shapes. As shown in (c) in FIG. 3, the hair dryer 10 may be coupled with a diffuser E that is not equipped with the additional functions, but has various shapes of a gas outlet through which gas is discharged. Furthermore, as shown in (a) and (b) in FIG. 3, the hair dryer 10 may be coupled with the diffuser 200 including a module 250 that performs the additional functions. That is, the diffuser 200 may perform a scalp and hair care function using LEDs, a scalp and hair care function using anions, and the like via the module unit 250.

However, when the hair dryer 10 is coupled with the diffuser 200 including the module 250 that performs the additional functions, it may be necessary to recognize that the diffuser 200 is coupled. That is, the hair dryer 10 may need to recognize that the diffuser 200 is coupled thereto and supply power to the module 250 such that the additional functions may be performed by the module 250. In other words, the hair dryer 10 may require easy coupling of the diffuser 200 including the module 250 that performs the additional functions. Furthermore, the hair dryer 10 may need the easy coupling of the diffuser 200 and the easy recognition of the coupling of the diffuser 200.

Accordingly, the hair dryer 10 according to one embodiment of the present disclosure may include a sensor assembly 130 that is disposed at a center of the main body 100 and senses the coupling of the diffuser 200. Furthermore, the hair dryer 10 may include a coupling portion 150 formed in an annular shape to surround the sensor assembly 130.

FIG. 5 is a view showing a main body according to one embodiment of the present disclosure. Specifically, (a) in FIG. 5 is an enlarged view of the main body, and (b) in FIG. 5 is a cross-sectional view of the main body.

Referring to FIGS. 1 and 5, the hair dryer 10 according to one embodiment of the present disclosure may include the main body 100 having the gas discharger 110 through which gas is discharged to the outside. Furthermore, the hair dryer 10 may include the handle 300 extending from the main body 100. The main body 100 may be extended in a cylindrical shape. Furthermore, the main body 100 may include the gas discharger 110 through which gas is discharged by opening a front side of the main body 100.

The gas discharger 110 may include the sensor assembly 130 disposed at a center of the gas discharger 110. The sensor assembly 130 may sense the coupling between the main body 100 and the diffuser 200 coupled to the main body 100. Furthermore, the gas discharger 110 may include the coupling portion 150 formed in the annular shape along a circumference of the gas discharger 110 to surround the sensor assembly 130. That is, the diffuser 200 may be coupled to the main body 100 via the coupling portion 150.

The coupling portion 150 may be disposed at an outermost side of the gas discharger 110 to come into contact with an inner circumferential surface of the main body 100. Accordingly, the coupling portion 150 may be supported by the inner circumferential surface of the main body 100. Furthermore, the coupling portion 150 may be disposed at the outermost side of the gas discharger 110 to maximally secure an area size thereof coupled to the diffuser 200.

As the coupling portion 150 is formed in the annular shape, the diffuser 200 may be coupled to the main body 100 via the coupling portion 150 independently of a coupling direction of the diffuser 200. The meaning of the diffuser 200 being coupled to the main body 100 via the coupling portion 150 independently of the coupling direction of the diffuser 200 is as follows. A rotation axis passing through the center of the main body 100 and a rotation axis passing through a center of the diffuser 200 may be the same. Furthermore, the diffuser 200 may be coupled to the main body 100 regardless of a rotation angle based on the rotation axis. That is, the diffuser 200 may rotate 360 degrees while being coupled to the main body 100. To sum up, the coupling of the diffuser 200 and the main body 100 may be achieved non-directionally.

Accordingly, the sensor assembly 130 disposed at the center of the gas discharger 110 may be disposed to face the diffuser 200. Specifically, the sensor assembly 130 may be located at the center of the diffuser 200 when the diffuser 200 is coupled thereto. Accordingly, the diffuser 200 may be coupled to the main body 100 independently of the coupling direction of the diffuser 200, and the sensor assembly 130 may sense the coupling of the diffuser 200 and the main body 100 independently of the coupling direction of the diffuser 200. A detailed relationship between the sensor assembly 130 and the diffuser 200 will be described later.

In one example, referring back to FIGS. 1 and 5, in the hair dryer 10 according to one embodiment of the present disclosure, the gas discharger 110 may further include a coupling auxiliary portion 170.

Specifically, the gas discharger 110 may include the coupling auxiliary portion 170 disposed between the coupling portion 150 and the sensor assembly 130. The coupling auxiliary portion 170 may be formed in an annular shape to surround the sensor assembly 130. The coupling auxiliary portion 170 may accommodate a portion of the diffuser 200 therein when the diffuser 200 is coupled. Accordingly, the coupling auxiliary portion 170 may further support the diffuser 200 in addition to the coupling of the diffuser 200 via the coupling portion 150. As a result, the diffuser 200 may be coupled to the main body 100 by receiving a great coupling force.

Furthermore, the gas discharger 110 may include a gas discharge hole 113 defined between the coupling auxiliary portion 170 and the coupling portion 150. Gas introduced via the main gas inlet 330 may pass through the main body 100 and be discharged to the outside via the gas discharge hole 113. That is, the hair dryer 10 may perform a basic function of drying the user's hair even when the diffuser 200 is not coupled thereto.

However, when an entirety of the gas discharger 110 is opened, a large amount of heated gas may be discharged via the gas discharger 110, and the hair or scalp of the user may be damaged. Furthermore, when the entirety of the gas discharger 110 is opened, it may be difficult for the user to dry the hair with a gentle flow of gas. Accordingly, a size of the gas discharge hole 113 may be adjusted by adjusting sizes of the coupling auxiliary portion 170 and the coupling portion 150. Thus, the user may dry the hair using the gentle flow of gas discharged via the gas discharge hole 113. Furthermore, the user may prevent damage to the hair and the scalp as much as possible by a flow rate adjusted via the gas discharge hole 113.

In one example, temperatures of the coupling portion 150 and the coupling auxiliary portion 170 may be increased by heated gas. When the coupling portion 150 and the coupling auxiliary portion 170 protrude forward, a probability that the user comes into contact with the coupling portion 150 and the coupling auxiliary portion 170 may increase, thereby increasing a risk of burns and injury. Accordingly, the coupling portion 150 and the coupling auxiliary portion 170 may be curved so as to be recessed rearward toward the sensor assembly 130. That is, the coupling portion 150 and the coupling auxiliary portion 170 may be prevented from protruding forwardly of the main body 100.

Specifically, as described above, the gas discharger 110 may be disposed at the front side of the main body 100. Furthermore, the coupling portion 150 may be curved so as to be recessed toward the sensor assembly 130. That is, the coupling portion 150 may be curved so as to be recessed rearward from one side thereof that is in contact with the inner circumferential surface of the main body 100 to the other side thereof that defines the gas discharge hole 113. Furthermore, the coupling auxiliary portion 170 may be curved so as to be recessed toward the sensor assembly 130. That is, the coupling auxiliary portion 170 may be curved so as to be recessed rearward from one side thereof that defines the gas discharge hole 113 to the other side thereof facing the sensor assembly 130. As a result, the probability that the user comes into contact with the coupling portion 150 and the coupling auxiliary portion 170 may be reduced, thereby reducing the risk of burns and injury.

Furthermore, the one side of the coupling auxiliary portion 170 that defines the gas discharge hole 113 may be disposed rearwardly of the other side of the coupling portion 150 that defines the gas discharge hole 113. That is, when viewing the main body 100 from the front, the coupling portion 150 and the coupling auxiliary portion 170 may be curved rearward while forming a continuous surface. Accordingly, when coupled with the main body 100, the diffuser 200 may be inserted into the main body 100 via the coupling portion 150 and the coupling auxiliary portion 170.

As a result, the diffuser 200 may increase the force of coupling with the main body 100. Furthermore, the sensor assembly 130 may be positioned close to a recognizing magnetic body 211, which will be described later, disposed inside the diffuser 200. That is, the sensor assembly 130 may easily sense magnetism of the recognizing magnetic body 211 and thus easily sense the coupling of the diffuser 200 and the main body 100. Furthermore, the sensor assembly 130 may maximally prevent sensing of magnetism of a coupling magnetic body 215, which will be described later, disposed in the diffuser 200 to be described later via the coupling auxiliary portion 170. That is, the sensor assembly 130 may more easily sense the magnetism of the recognition magnetic body 211 by the coupling auxiliary portion 170.

In one example, the sensor assembly 130 may include a sensor 131 that senses magnetism generated by the diffuser 200. The sensor 131 may be a hall IC. The hall IC, as an integrated circuit used for non-contact displacement detection or the like, may mean a circuit integrated by assembling a hall element, an amplifier, or the like in a silicon chip. The sensor 131 may be disposed to sense the coupling of the diffuser 200 and the main body 100. That is, the controller 700 may sense the magnetism of the diffuser 200 via the sensor 131 to determine that the diffuser 200 and the main body 100 are coupled to each other.

However, the sensor 131 may be damaged by exposure to high-temperature gas or external impact. Accordingly, the hair dryer 10 according to one embodiment of the present disclosure may include a sensor protecting portion 135.

Specifically, the sensor assembly 130 may include a sensor seating portion 133 disposed at the center of the gas discharger 110. The sensor seating portion 133 may include a sensor seating surface 1331 disposed at the center of the gas discharger 110. The sensor seating surface 1331, as a surface to which the sensor 131 is directly coupled, may be formed in a flat shape. The sensor seating portion 133 may further include a sensor receiving portion 1333 extending forward from the sensor seating surface 1331. Furthermore, the sensor receiving portion 1333 may include a sensor receiving groove 1335 to provide a space in which the sensor 131 is received. That is, the sensor 131 may be received in the sensor receiving groove 1335 and coupled to the sensor seating surface 1331. As a result, the sensor 131 may be maximally prevented from being in contact with the external impact and the high-temperature gas, thereby reducing a risk of breakage and failure.

Furthermore, the sensor assembly 130 may include the sensor protecting portion 135 extending forward from the sensor seating portion 133 to surround the sensor. Specifically, the sensor protecting portion 135 may protrude forwardly of the sensor receiving portion 1333. Furthermore, the sensor protecting portion 135 may include a first sensor protecting portion 1351 having a diameter that decreases forwardly. That is, the first sensor protecting portion 1351 may be formed in a cone shape. Accordingly, exposure of the sensor 131 to the outside may be prevented by the sensor seating portion 133 and the sensor protecting portion 135. Thus, when the user uses the hair dryer 10 without coupling the same to the diffuser 200, the sensor 131 may be protected from the external impact. Furthermore, even when the user uses the hair dryer 10 by coupling the same to the diffuser 200, the sensor 131 may be protected from the external impact. Furthermore, the sensor 131 may be maximally prevented from being in contact with the heated gas, so that the damage and the failure may be reduced.

Furthermore, the sensor protecting portion 135 may be prevented from protruding forwardly of an outer circumferential surface of the main body 100 that forms an outer appearance of the hair dryer 10. As a result, the sensor protecting portion 135 may protect the sensor 131 and prevent the damage resulted from the external impact as much as possible.

More specifically, the sensor protecting portion 135 may include a second sensor protecting portion 1353 that is spaced apart from the first sensor protecting portion 1351 in a radial direction of the gas discharger 110. The second sensor protecting portion 1353 may be disposed to surround the first sensor protecting portion 1351. Furthermore, the second sensor protecting portion 1353 may be disposed to be in contact with the coupling auxiliary portion 170. Accordingly, even when the coupling auxiliary portion 170 is damaged, access to the sensor assembly 130 may be prevented as much as possible. Furthermore, structural safety of the coupling auxiliary portion 170 may be increased by receiving a supporting force by the second sensor protecting portion 1353.

Thus, when the user uses the hair dryer 10 without coupling the same to the diffuser 200, the sensor 131 may be more effectively protected from the external impact. Furthermore, when the user uses the hair dryer 10 by coupling the same to the diffuser 200, the sensor 131 may be more effectively protected from the external impact.

As described above, in the hair dryer 10 according to one embodiment of the present disclosure, the coupling portion 150 may be disposed to facilitate the coupling of the diffuser 200. Furthermore, the sensor assembly 130 may be disposed to sense the coupling of the diffuser 200 independently of a rotation direction of the one surface of the diffuser 200 coupled to the coupling portion 150. It is preferable that the diffuser 200 has an internal configuration corresponding thereto.

Accordingly, in the hair dryer 10 according to one embodiment of the present disclosure, the recognizing magnetic body 211 of the diffuser 200 may be disposed at a position corresponding to the sensor assembly 130.

FIG. 6 is a view showing a diffuser according to one embodiment of the present disclosure. FIG. 7 is a diagram showing a portion where a main body and a diffuser are coupled to each other according to one embodiment of the present disclosure. Specifically, (a) in FIG. 6 is a perspective view of the diffuser, and (b) in FIG. 6 is a cross-sectional view of the diffuser.

Referring to FIGS. 6 and 7, in the hair dryer 10 according to one embodiment of the present disclosure, the recognizing magnetic body 211 of the diffuser 200 may be disposed at the position corresponding to the sensor assembly 130.

Specifically, the diffuser 200 may include a housing 240 that forms an outer appearance thereof. The diffuser 200 may include a gas inlet 210 disposed at one side of the housing 240. The gas inlet 210 may be in communication with the gas discharger 110, so that gas may be introduced from the gas discharger 110.

The gas inlet 210 may include the recognizing magnetic body 211 disposed at the position corresponding to the sensor assembly 130. The recognizing magnetic body 211 may be formed to have magnetism. The sensor assembly 130 may sense the coupling of the diffuser 200 and the main body 100 by sensing the magnetism of the recognizing magnetic body 211. When the sensor assembly 130 senses the coupling of the diffuser 200 and the main body 100, the controller 700 may recognize the coupling of the diffuser 200 and the main body 100 and may supply the power to the diffuser 200. Furthermore, the controller 700 may allow the diffuser 200 to perform the additional functions.

As described above, the sensor assembly 130 may be disposed at the center of the gas discharger 110. Accordingly, the recognizing magnetic body 211 may be disposed at the center of the gas inlet 210. That is, when the main body 100 and the diffuser 200 are coupled to each other, one surface where the main body 100 and the diffuser 200 face each other may be constant. Furthermore, the diffuser 200 may maintain the coupling even when rotated while being coupled with the main body 100, and the sensor assembly 130 and the recognizing magnetic body 211 may maintain the same positions. Accordingly, the sensor assembly 130 may face the recognizing magnetic body 211 regardless of a coupling direction (a rotation direction using a virtual line passing through the center of the diffuser as a rotation axis) of one surface where the diffuser is coupled to the hair dryer. That is, when the diffuser 200 is coupled to the main body 100, the sensor assembly 130 may always sense the magnetism of the recognizing magnetic body 211. Thus, the user may use the hair dryer 10 by easily coupling the diffuser 200 with the main body 100. Furthermore, the user may easily use the additional functions of the diffuser 200 when using the diffuser 200 equipped with the additional functions.

In one example, the diffuser 200 may be inserted into and coupled to the main body 100. Furthermore, a portion of the main body 100 may be inserted into and coupled to the diffuser 200. The diffuser 200 and the main body 100 may be constructed to be inserted into each other, so that a coupling strength may be increased. However, when the diffuser 200 and the main body 100 are coupled to each other only by the insertion, the user may feel uncomfortable. That is, when the diffuser 200 and the main body 100 are coupled to each other in a tight fit manner, a strong coupling force may be obtained, but the user may have difficulty in mounting and dismounting the diffuser 200. Furthermore, when the diffuser 200 and the main body 100 are coupled to each other in a loose fit manner, the diffuser 200 may be removed with only a small external impact.

Accordingly, the hair dryer 10 according to one embodiment of the present disclosure may include the coupling magnetic body 215 for coupling the diffuser 200 and the main body 100 to each other.

Referring back to FIGS. 6 and 7, the gas inlet 210 may include a main body coupling portion 213 formed in an annular shape along a circumference of the gas inlet 210 to surround the recognizing magnetic body 211. The main body coupling portion 213 may be disposed at a position corresponding to the coupling portion 150. That is, when the diffuser 200 is coupled to the main body 100, the main body coupling portion 213 may be disposed to face the coupling portion 150. In other words, the coupling portion 150 and the body coupling portion 213 may be formed in the annular shape to allow the coupling to be achieved regardless of the coupling direction (the rotation direction using the virtual line passing through the center of the diffuser as the rotation axis) of the one surface where the diffuser is coupled to the hair dryer when the diffuser 200 and the main body 100 are coupled to each other.

Furthermore, the gas inlet 210 may include the coupling magnetic body 215 formed in the annular shape in the main body coupling portion 213. The coupling magnetic body 215 may be coupled to the coupling portion 150 by a magnetic force. Accordingly, the coupling portion 150 may be made of a material such as metal so as to be coupled with the coupling magnetic body 215 by the magnetic force. As the coupling portion 150 is formed in the annular shape, it may be preferable that the coupling magnetic body 215 is formed in a corresponding annular shape so as to be coupled with the coupling portion 150 with a large area size.

The main body coupling portion 213 may include a coupling magnetic body receiving portion 2131 defined as one surface of the main body coupling portion 213 facing the coupling portion 150 is recessed. The coupling magnetic body 215 may be received in the coupling magnetic body receiving portion 2131. That is, the coupling magnetic body 215 may be inserted into and coupled to the coupling magnetic body receiving portion 2131. Furthermore, the coupling magnetic body 215 may be coupled to the coupling magnetic body receiving portion 2131 using an adhesive or the like. Accordingly, the coupling magnetic body 215 may be fixed in position by the coupling magnetic body receiving portion 2131, and exposure thereof to the external impact may be minimized. That is, a possibility of breakage of the coupling magnetic body 215 may be reduced.

In one example, the diffuser 200 may further include a receiving coupling portion 241 to have a great coupling force with the main body 100. That is, the housing 240 may include a receiving coupling portion 241 extending from an outer circumferential surface of the main body coupling portion 213 toward the main body 100. The receiving coupling portion 241 may be constructed to receive the main body 100 therein. That is, the main body coupling portion 213 may be coupled to the main body 100 such that the receiving coupling portion 241 surrounds the main body 100. As a result, the diffuser 200 may receive the great coupling force with the main body 100 via the receiving coupling portion 241. Furthermore, the receiving coupling portion 241 may protect the inside of the main body 100 where the sensor assembly 130, the temperature adjust unit 120, and the like are disposed from the external impact.

As described above, the recognizing magnetic body 211 and the coupling magnetic body 215 may be formed to have the magnetism. However, it may be preferable that the sensor assembly 130 senses only the magnetism of the recognizing magnetic body 211 to accurately sense the coupling of the diffuser 200 and the main body 100. Accordingly, the recognizing magnetic body 211 may have first magnetism. Furthermore, the coupling magnetic body 215 may have second magnetism different from the first magnetism. The first magnetism may be of an N pole or an S pole. The second magnetism may be of the S pole or the N pole opposite to the first magnetism. That is, when the recognizing magnetic body 211 has the S pole, the sensor assembly 130 may recognize only the S pole. Thus, the sensor assembly 130 may more easily sense the magnetism of the recognizing magnetic body 211. Furthermore, the sensor assembly 130 may more easily and accurately sense the coupling of the diffuser 200 and the main body 100.

Furthermore, in the hair dryer 10 according to one embodiment of the present disclosure, the coupling auxiliary portion 170 may be non-magnetic to facilitate the sensing, by the sensor assembly 130, of the magnetism of the recognizing magnetic body 211.

Referring to FIG. 6, when the diffuser 200 and the main body 100 are coupled to each other, the coupling auxiliary portion 170 may be positioned between the main body coupling portion 213 having the coupling magnetic body 215 of the gas discharger 110 and the sensor assembly 130. Accordingly, the coupling auxiliary portion 170 may be non-magnetic to prevent the magnetism of the coupling magnetic body 215 from reaching the sensor assembly 130 as much as possible. Furthermore, because the coupling auxiliary portion 170 is prevented from coupling with the coupling magnetic body 215, when the diffuser 200 is coupled to the main body 100, the coupling of the main body coupling portion 213 and the coupling portion 150 may be more easily performed by the coupling magnetic body 215.

Accordingly, the user may more easily couple the diffuser 200 and the main body 100 to each other, and the sensor assembly 130 may more easily sense the magnetism of the recognizing magnetic body 211 by the auxiliary coupling portion 170. Furthermore, as the controller 700 may easily recognize the coupling of the diffuser 200 and the main body 100, the additional functions of the diffuser 200 may be performed more easily.

The recognizing magnetic body 211 is an important component enabling the sensor assembly 130 to sense the coupling of the diffuser 200 and the main body 100. Accordingly, the hair dryer 10 according to one embodiment of the present disclosure may include a recognizing magnetic body receiving portion 2179 that receives and protects the recognizing magnetic body 211.

Referring back to FIGS. 6 and 7, the hair dryer 10 according to one embodiment of the present disclosure may include the recognizing magnetic body receiving portion 2179. Specifically, the gas inlet 210 may include the recognizing magnetic body receiving portion 2179 disposed at the center of the gas inlet 210 to surround the recognizing magnetic body. The recognizing magnetic body receiving portion 2179 may be disposed to surround the recognizing magnetic body. That is, the recognizing magnetic body 211 may be received inside and fixedly coupled to the recognizing magnetic body receiving portion 2179. Accordingly, the recognizing magnetic body 211 may be protected from the external impact by the recognizing magnetic body receiving portion 2179. Furthermore, the recognizing magnetic body receiving portion 2179 may fix the position of the recognizing magnetic body 211 such that the sensor assembly 130 may easily sense the magnetism of the recognizing magnetic body 211. Thus, the recognizing magnetic body receiving portion 2179 may reduce the possibility of breakage and failure of the recognizing magnetic body 211. Furthermore, the recognizing magnetic body receiving portion 2179 may enable the sensor assembly 130 to easily sense the coupling of the diffuser 200 to the main body 100. In other words, convenience of the user may be increased when the user uses the additional functions of the diffuser 200.

Furthermore, the gas inlet 210 may further include a first receiving circumferential wall 2175 disposed to surround the recognizing magnetic body receiving portion 2179 to more efficiently protect the recognizing magnetic body 211. That is, the first receiving circumferential wall 2175 may be spaced apart from the recognizing magnetic body receiving portion 2179 in a radial direction of the gas inlet 210. Furthermore, a terminal for supplying the power to the diffuser 200 and other components may be received in a space between the first receiving circumferential wall 2175 and the recognizing magnetic body receiving portion 2179. Furthermore, when the impact is applied from the outside, the first receiving circumferential wall 2175 may absorb the impact prior to the recognizing magnetic body receiving portion 2179. Thus, an internal space of the diffuser 200 may be efficiently utilized by the first receiving circumferential wall 2175. Furthermore, the first receiving circumferential wall 2175 may protect the recognizing magnetic body 211 more efficiently.

Furthermore, the gas inlet 210 may further include a second receiving circumferential wall 2177 disposed to surround the first receiving circumferential wall 2175 to more efficiently protect the recognizing magnetic body 211. That is, the second receiving circumferential wall 2177 may be spaced apart from the first receiving circumferential wall 2175 in the radial direction of the gas inlet 210. Furthermore, the terminal for supplying the power to the diffuser 200 and other components may be received in a space between the second receiving circumferential wall 2177 and the first receiving circumferential wall 2175. Furthermore, when the impact is applied from the outside, the second receiving circumferential wall 2177 may absorb the impact prior to the recognizing magnetic body receiving portion 2179 and the first receiving circumferential wall 2175. Thus, the internal space of the diffuser 200 may be efficiently utilized by the second receiving circumferential wall 2177. Furthermore, the second receiving circumferential wall 2177 may protect the recognizing magnetic body 211 more efficiently.

Furthermore, the gas inlet 210 may include a gas inlet hole 212 defined between the recognizing magnetic body receiving portion 2179 and the main body coupling portion 213. Gas that has passed through the gas discharge hole 113 may be introduced into the gas inlet hole 212. Specifically, the gas inlet hole 212 may be defined between an outer circumferential surface of the second receiving circumferential wall 2177 and an inner circumferential surface of the main body coupling portion 213. Accordingly, the recognizing magnetic body 211 may be prevented from being in contact with heated gas discharged from the gas discharge hole 113 as much as possible. Accordingly, the recognizing magnetic body 211 may be prevented from being deformed resulted from the contact with heated gas. Furthermore, the gas inlet hole 212 may be defined to face the gas discharge hole 113 when the diffuser 200 and the main body 100 are coupled to each other. Accordingly, gas that has passed through the gas discharge hole 113 may flow into the gas inlet hole 212 without changing a flow channel. That is, a flow resistance of the gas flow may be reduced. As a result, because the flow smoothly formed by the gas inlet hole 212 is discharged via the diffuser 200, the convenience of the user who dries the hair using the flow may be increased.

Furthermore, as described above, the sensor assembly 130 may include the first sensor protecting portion 1351 and the second sensor protecting portion 1353. The first sensor protecting portion 1351 may face the recognizing magnetic body receiving portion 2179. Furthermore, the first sensor protecting portion 1351 may be disposed to surround the recognizing magnetic body 211 to efficiently protect the sensor 131. That is, the first sensor protecting portion 1351 may allow the sensor 131 to be received in an enclosed space.

However, as described above, the first sensor protecting portion 1351 may have a diameter decreasing as it approaches the recognizing magnetic body receiving portion 2179 to efficiently utilize an internal space thereof. That is, the diameter of the first sensor protecting portion 1351 may decrease forward. Accordingly, the recognizing magnetic body receiving portion 2179 may have a receiving recessed portion 2176 defined as one surface of the recognizing magnetic body receiving portion 2179 facing the first sensor protecting portion 1351 is recessed. At least a portion of the first sensor protecting portion 1351 may be received in the receiving recessed portion 2176.

Thus, the sensor assembly 130 may be protected in multiple ways by the first sensor protecting portion 1351 and the receiving recessed portion 2176 constructed to cover the first sensor protecting portion 1351. Furthermore, the first sensor protecting portion 1351 and the accommodating recessed portion 2176 are constructed to be engaged with each other to increase the coupling force when the diffuser 200 and the main body 100 are coupled to each other.

In one example, as described above, the diffuser 200 may be equipped with the additional functions and may provide the additional functions to the user when coupled to the main body 100. That is, the hair dryer 10 according to one embodiment of the present disclosure may provide the scalp and hair care function using LEDs via the diffuser 200.

FIG. 9 is a view showing a hair dryer that performs additional functions by a diffuser according to an embodiment of the present disclosure.

Referring to FIGS. 3, 4, 6, and 9, the diffuser 200 may further include the module 250 disposed inside the housing 240. The module 250 may include a plurality of lamps 251. The lamps 251 may be spaced apart from a center of the module 250 in a radial direction of the module 250. Accordingly, light emitted from the lamps 251 may be radiated in a wide range via the other side of the housing 240. That is, the lamp 251 may radiate light toward a wide area size of the user's hair and scalp. As a result, the user may efficiently care for the hair and the scalp. The lamps 251 may be constructed as the LEDs. However, the present disclosure may not be limited thereto and the lamps may be formed in various shapes for the hair and scalp care.

Furthermore, only the scalp and hair care function using the LEDs of module 250 has been described, but the additional functions of the module 250 may be various functions including the scalp and hair care function using anions.

Furthermore, the housing 240 may have a gas flow forming unit 260 attached to the other side thereof through which gas is discharged. That is, the gas flow forming unit 260 may provide the smooth flow to the user. Specifically, the gas flow forming unit 260 may have a plurality of annular frames 261 spaced apart from each other in a radial direction of the gas flow forming unit 260. Accordingly, the gas flow forming unit 260 may have a plurality of outlets 263 in the radial direction of the gas flow forming unit 260. Thus, the user may receive the smooth flow of gas via the plurality of outlets 263.

Furthermore, the gas flow forming unit 260 may further include a support rib 265 disposed between the annular frames 261 and connected to the annular frames 261 on both sides. Thus, structural stability of the gas flow forming unit 260 may be increased via the support rib 265.

In one example, when the hair dryer 10 is coupled with the diffuser 200 including the module 250 that performs the additional functions, the power needs to be supplied to the diffuser 200. That is, the diffuser 200 may require the power to turn on the LEDs or generate the anions.

Accordingly, referring to FIGS. 5 to 7, the first sensor protecting portion 1351 may have a first polarity. Furthermore, the second sensor protecting portion 1353 may have a second polarity different from the first polarity. That is, a (+) terminal and a (−) terminal may be required to supply the power. Accordingly, when the first sensor protecting portion 1351 is constructed as the (+) terminal, the second sensor protecting portion 1353 may be constructed as the (−) terminal. Conversely, when the first sensor protecting portion 1351 is constructed as the (−) terminal, the second sensor protecting portion 1353 may be is constructed as the (+) terminal. Accordingly, the first sensor protecting portion 1351 and the second sensor protecting portion 1353 may supply the power to the diffuser 200 while protecting the sensor assembly 130.

Furthermore, as described above, the first sensor protecting portion 1351 and the second sensor protecting portion 1353 may be spaced apart from each other. As a result, short circuits (meaning direct connection between two terminals or two points in an electric circuit without passing through a load) that may occur resulted from a contact between the first sensor protecting portion 1351 and the second sensor protecting portion 1353 may be prevented as much as possible.

Furthermore, the diffuser 200 may further include a module power receiver 230. The module power receiver 230 may receive the power by being in contact with the first sensor protecting portion 1351 and the second sensor protecting portion 1353. The module power receiver 230 may include a first power receiving terminal 231 corresponding to the first sensor protecting portion 1351. Furthermore, the module power receiving unit 230 may include a second power receiving terminal 233 corresponding to the second sensor protecting portion 1353.

The first power receiving terminal 231 may be received in and coupled to the space defined between the first receiving circumferential wall 2175 and the recognizing magnetic body receiving portion 2179. Furthermore, the second power receiving terminal 233 may be received in and coupled to the space defined between the first receiving circumferential wall 2175 and the second receiving circumferential wall 2177.

Furthermore, the gas inlet 210 may have one surface D facing the gas discharger 110 at the center of the gas inlet 210. The recognizing magnetic body receiving portion 2179, the first receiving circumferential wall 2175, the second receiving circumferential wall 2177, and the like may be disposed on the one surface facing the gas discharger 110 at the center of the gas inlet 210. Accordingly, an end of the first power receiving terminal 231 may be in contact with the first sensor protecting portion 1351 through the one surface facing the gas discharger 110 at the center of the gas inlet 210. Furthermore, an end of the second power receiving terminal 233 may be in contact with the first sensor protecting portion 1351 through the one surface facing the gas discharger 110 at the center of the gas inlet 210.

As a result, the first power receiving terminal 231 may be efficiently protected from the external impact and come into contact with the first sensor protecting portion 1351 to receive the power from the first sensor protecting portion 1351. Furthermore, the second power receiving terminal 233 may be efficiently protected from the external impact and come into contact with the second sensor protecting portion 1353 to receive the power from the second sensor protecting portion 1353.

In one example, when the diffuser is not coupled, the hair dryer 10 may include a gas discharge auxiliary hole 115 to provide an efficient gas flow to the user.

FIG. 8 is a view showing a main body having a gas discharge auxiliary hole defined therein according to one embodiment of the present disclosure. Referring to FIG. 8, in the hair dryer 10 according to one embodiment of the present disclosure, the gas discharge auxiliary hole 115 may be defined between the first sensor protecting portion 1351 and the second sensor protecting portion 1353. Accordingly, gas inside the hair dryer may be discharged to the outside via the gas discharge auxiliary hole 115 and the gas discharge hole 113. The user may dry the hair using gas discharged via the gas discharge auxiliary hole 115 and the gas discharge hole 113. The gas discharge auxiliary hole 115 assists the gas discharge hole 113 to provide sufficient gas to the user. As a result, the user's convenience may be increased. Furthermore, utilization efficiency of an internal space of the hair dryer 10 may be increased.

Although representative embodiments of the present disclosure have been described in detail above, those of ordinary skill in the technical field to which the present disclosure belongs will understand that various modifications are possible with respect to the above-described embodiment without departing from the scope of the present disclosure. Therefore, the scope of the present disclosure should not be limited to the described embodiment, and should be defined not only by the claims described below, but also by these claims and equivalents thereof.

What is claimed is:

1. A hair dryer comprising:

a main body having a gas discharger configured to discharge gas; and a handle disposed on the main body, wherein the gas discharger includes:

a sensor assembly disposed at a center of the gas discharger and configured to sense coupling of a diffuser to be coupled to the main body; and a coupling portion surrounding the sensor assembly and formed in an annular shape along a circumference of the gas discharger, wherein the diffuser is coupled to the main body via the coupling portion, and the sensor assembly faces the diffuser.

2. The hair dryer of claim 1, wherein the gas discharger further includes:

a coupling auxiliary portion disposed between the coupling portion and the sensor assembly and formed in an annular shape to surround the sensor assembly; and a gas discharge hole defined between the coupling auxiliary portion and the coupling portion, wherein gas is discharged via the gas discharge hole.

3. The hair dryer of claim 2, wherein the gas discharger is disposed at a front side of the main body, and the coupling portion and the coupling auxiliary portion are curved to be recessed rearward toward the sensor assembly.

4. The hair dryer of claim 1, wherein the gas discharger is disposed at a front side of the main body, wherein the sensor assembly includes:

a sensor configured to sense the coupling of the diffuser and the main body using magnetism generated from the diffuser;

a sensor seating portion disposed at the center of the gas discharger, wherein the sensor is seated on the sensor seating portion; and a sensor protecting portion extending forward from the sensor seating portion and surrounding the sensor.

5. The hair dryer of claim 1, wherein the diffuser includes:

a housing forming an outer appearance of the diffuser; and a gas inlet disposed at one side of the housing and in communication with the gas discharger to allow gas to be introduced from the gas discharger, wherein the gas inlet includes a recognizing magnetic body disposed at a position corresponding to the sensor assembly and having magnetism, wherein the sensor assembly senses the coupling of the diffuser and the main body using the magnetism of the recognizing magnetic body.

6. The hair dryer of claim 5, wherein the gas inlet further includes:

a main body coupling portion formed in an annular shape along a circumference of the gas inlet to surround the recognizing magnetic body and disposed at a position corresponding to the coupling portion; and a coupling magnetic body formed in an annular shape in the main body coupling portion and coupled to the coupling portion by a magnetic force.

7. The hair dryer of claim 6, wherein the main body coupling portion includes a coupling magnetic body receiving portion defined as one surface of the main body coupling portion facing the coupling portion is recessed, wherein the coupling magnetic body receiving portion receives the coupling magnetic body therein.

8. The hair dryer of claim 6, wherein the housing includes a receiving coupling portion extending from an outer circumferential surface of the main body coupling portion toward the main body and receiving the main body therein, wherein the main body coupling portion is coupled to the main body such that the receiving coupling portion surrounds the main body.

9. The hair dryer of claim 6, wherein the recognizing magnetic body has first magnetism and the coupling magnetic body has second magnetism different from the first magnetism, wherein the sensor assembly senses the first magnetism.

10. The hair dryer of claim 6, wherein the gas inlet further includes a recognizing magnetic body receiving portion disposed at a center of the gas inlet to surround the recognizing magnetic body, and providing a space for receiving the recognizing magnetic body.

11. The hair dryer of claim 10, wherein the sensor assembly includes:

a sensor configured to sense the magnetism of the recognizing magnetic body;

a sensor seating portion disposed at the center of the gas discharger, wherein the sensor is seated on the sensor seating portion; and a sensor protecting portion extending from the sensor seating portion toward the recognizing magnetic body and disposed to surround the sensor, wherein one surface of the recognizing magnetic body receiving portion facing the sensor protecting portion is recessed to receive at least a portion of the sensor protecting portion therein.

12. The hair dryer of claim 10, wherein the gas discharger further includes a coupling auxiliary portion disposed between the coupling portion and the sensor assembly and formed in an annular shape to surround the sensor assembly, wherein the coupling auxiliary portion is non-magnetic.

13. The hair dryer of claim 12, wherein the gas discharger further includes a gas discharge hole defined between the coupling auxiliary portion and the coupling portion, wherein gas is discharged to the outside via the gas discharge hole, wherein the gas inlet further includes a gas inlet hole defined between the recognizing magnetic body receiving portion and the main body coupling portion, wherein gas that has passed through the gas discharge hole is introduced into the gas inlet hole.

14. The hair dryer of claim 5, wherein the diffuser further includes a module disposed inside the housing, wherein the module includes a plurality of lamps spaced apart from a center of the module in a radial direction of the module, wherein the lamp is turned on when the sensor assembly senses the coupling of the diffuser and the coupling portion.

* * * * *